United States Patent [19]

van der Tak

[11] 4,315,476

[45] Feb. 16, 1982

[54] STEERING SYSTEM FOR A SHIP

[76] Inventor: Josephus A. M. van der Tak, 47 Wassenaarseweg, The Hague, Netherlands

[21] Appl. No.: 196,673

[22] Filed: Oct. 14, 1980

[51] Int. Cl.[3] ..... B63H 25/46

[52] U.S. Cl. ..... 114/151; 114/246

[58] Field of Search ..... 114/166, 150, 151, 77 R, 114/246; 137/875, 625.44; 440/43

[56] References Cited

U.S. PATENT DOCUMENTS 3,545,470 12/1970 Paton ..... 137/875

3,570,539 3/1971 Herring ..... 137/625.44

FOREIGN PATENT DOCUMENTS 197801 1/1978 Netherlands ..... 114/151

649919 2/1979 U.S.S.R. ..... 137/875

*Primary Examiner*—Sherman D. Basinger

*Attorney, Agent, or Firm*—Richard G. Lione

[57] ABSTRACT

A steering system comprising a propeller in a flow duct across a ship is provided with a wedge shaped valve to shift the flow direction between the sides of the ship, which wedge shaped valve has its vertical pivot shaft in the wedge center line directed into the onflow and its wedge sides arranged as flow guides.

3 Claims, 4 Drawing Figures

STEERING SYSTEM FOR A SHIP

This invention relates to a steering system for a ship, comprising a flow duct formed in the ship, a steering propeller arranged in said flow duct, a duct nozzle at each of the sides of the ship, and at least one flow shifting valve in said flow duct for directing the flow.

In the usual arrangement of this type of steering system the duct and the propeller are transversely directed whereby the ship is to be manoeuvered by directing the flow to the duct nozzle at either port or starboard.

A difficulty is, however, that when the ship moves at a speed of more than 4–5 knots the rapidly passing flow along the hull exerts such a great suction force on the inlet nozzle of the duct that the supply pressure to the propeller becomes too low so that the steering effect is detrimentally affected. To solve this problem the duct nozzles in the hull are widened longitudinally of the ship and a flow shifting valve is centrally arranged in each of said longitudinally widened nozzles to form forwardly and rearwardly diverted flow branches in each nozzle to promote the inflow passing through the forwardly directed branch on one side of the ship to outflow through the rearwardly directed branch on the other side of the ship in a favourable flow pattern which is beneficial to the steering effect. This involves that the valves on the respective sides of the ship are operated by a common control to be oppositely shifted.

A further major problem is, however, that when a vane type of valve would be used for directing the flow in the wide nozzle opening large pockets will be present in the hull on the backside of such a type of valve, which will create turbulences, and to also solve this problem the now invented steering system is characterized in that the flow shifting valve consists of a butterfly or wedge shaped valve having its pivot shaft vertically in the flow duct axis with its butterfly or wedge sides converging against the flow to act as flow guides flush with the duct wall and the hull of the ship so that on the backside of the valve no pocket is present to create turbulences but the flow runs perfectly flush along the hull.

Accordingly, the present invention also comprises a flow shifting valve for use in a steering system as described, characterized in that it comprises a butterfly or wedge valve, the sides of which are adapted to act as flow guides flush with the flow duct wall and the hull of the ship.

The invented steering system is particularly useful for a new type of ship, of which the hull is adapted to be divided, at about a quarter of its length from the bow, in a steering boat and a propulsion boat, which are respectively to be arranged fore and aft of a tow of barges, and which steering boat is provided with a steering system and flow shifting valve(s) as here disclosed.

The invention is described in more detail in the following specification with reference to the drawing, in which the invention is illustrated.

Figure 1:
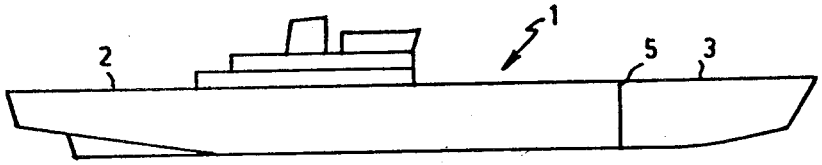
FIG. 1 is a schematic side view of a ship which is divided in a rear propulsion section and a bow steering section.
Figure 2:
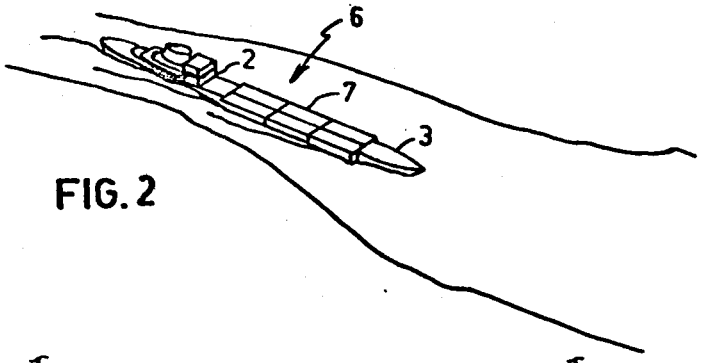
FIG. 2 is a schematic general perspective view of a tow of barges, which is propelled by a push boat, with ahead a steering boat according to the invention.

The ship 1 as represented in FIG. 1 and 2 is divided in a rear propulsion section or push boat 2 and a bow section 3 which is provided with a steering system 4 according to the present invention. The ship 1 is to be divided at about a quarter of its length from the bow as schematically indicated at 5.

In FIG. 2 a tow of vessels is indicated at 6, comprising a number of consecutive adjoining pairs of barges 7, with astern a push boat 2 and ahead a steering boat 3, which provide such a good steerability that even more than three pairs of barges 7 are to be arranged in the tow 6.

Figure 3:
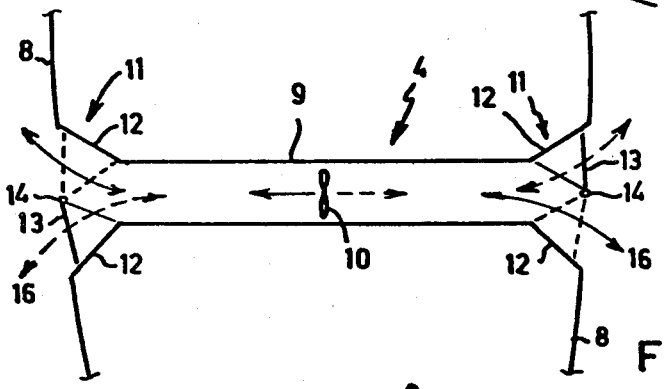
FIG. 3 is a schematic plan view of a steering propeller which is arranged in a flow duct and of the nozzles of the duct.
Figure 4:
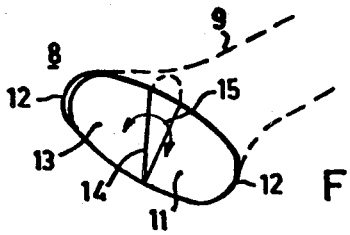
FIG. 4 is schematic outboard view of the shifting valve as shown in FIG. 3.

FIGS. 3 and 4 show an embodiment of the steering system 4 the steering boat 3 is provided with.

In FIG. 3 a steering propeller 10 arranged in a flow duct 9 extending between the boards 8 of the boat 3 is illustrated, which is steerable in opposite directions in order to turn the boat 3 and therewith the entire tow of vessels 6 to port or starboard.

The duct 9 has at each of its ends nozzles 11 which are each adapted to form a pair of branches 12 by means of a shifting valve 13 which is centrally arranged in the nozzle on a vertical pivot shaft 14 to provide in this manner an inflow afore and an outflow abaft, respectively, through the pertaining nozzle 11. The extreme positions of the valve 13 to each side are indicated with full lines and dotted lines, respectively, in FIG. 3, and in FIG. 4 the shiftability of the valve is indicated with a double arcuate arrow 15.

By widening the duct nozzles 11 as indicated and an inflow afore through the inlet nozzle 12, mated with an outflow abaft through the opposite outlet nozzle 12, more water, at an increased supply pressure, is delivered to the propeller 10. The shifting valves 13 on each end of the duct 9 consist as shown of a butterfly or wedge shaped valve and are each time oppositely shifted by a mated control not shown. When steering in opposite sense to the other hull side direction, the propeller 10 is each time turned and the valves 13 are shifted in opposite direction as indicated by the arrow 15. As seen in FIG. 4, the nozzle opening in the hull side has rounded fore and aft ends and the wedge-shaped valve 13 is shaped as a wedge from a cheese ring so as to mate snugly with the insides of the nozzle at its rounded ends.

Due to the forwardly curved shape of the hull sides 8 at the location of the nozzles 11 and due to the widened shape of the duct nozzles 11 more water is supplied to the propeller 10 as indicated by the arrows 16.

It will be noticed that the steering system 4 shown in FIG. 3 is adapted to eventually also be installed as a propulsion and steering device longitudinally in the symmetry axis in the stern of a ship.

The wedge valve 13 is directed with its wedge corner line into the flow and its wedge sides act as flow guides flush with the flow duct wall and with the hull of the ship so that no turbulences are created.

Having thus described my invention what I claim is:

1. In a steering system for a ship including a hull, a flow duct formed through said hull and opening through the side of the hull in a longitudinally elongated duct nozzle at each end of the flow duct, a propeller rotatable in said flow duct, and a flow shifting valve in at least one of said nozzles, the improvement comprising:

(a) said flow shifting valve being mounted in said one nozzle for pivotal movement about a vertical axis lying substantially in the plane of the hull side through which said nozzle opens;

(b) said valve being wedge-shaped with opposite wedge sides which converge towards said pivot axis; and (c) said valve being movable about said axis whereby in one position of said valve one of said wedge sides is flush with said hull side and the other of said wedge sides acts as a flow guide, and in another position of said valve the other of said wedge sides is flush with said hull side and the one wedge side acts as a flow guide.

2. The improvement in a steering system of claim 1 further characterized in that:

(a) said one nozzle opening in the hull side has rounded ends fore and aft, with the wedge-shaped valve being shaped like a wedge from a cheese ring so as to mate snugly with the inside surface of said nozzle both fore and aft.

3. A ship assembly comprising:

(a) a rear push boat;

(b) a front steering boat;

(c) at least one barge between and separable from said boats;

(d) said steering boat being provided with the improvement in a steering system of claim 1.

* * * * *